US009878231B2

(12) United States Patent
Lunt

(10) Patent No.: US 9,878,231 B2
(45) Date of Patent: Jan. 30, 2018

(54) MILITARY-BASED GAMING SYSTEM

(71) Applicant: Harold L. Lunt, Brooksville, FL (US)

(72) Inventor: Harold L. Lunt, Brooksville, FL (US)

( * ) Notice: Subject to any disclaimer, the term of this patent is extended or adjusted under 35 U.S.C. 154(b) by 0 days.

(21) Appl. No.: 15/155,318

(22) Filed: May 16, 2016

(65) Prior Publication Data

US 2017/0326436 A1 Nov. 16, 2017

(51) Int. Cl.
*A63F 1/00* (2006.01)
*A63F 1/02* (2006.01)

(52) U.S. Cl.
CPC . *A63F 1/00* (2013.01); *A63F 1/02* (2013.01)

(58) Field of Classification Search
CPC ..... A63F 1/12
USPC ..... 273/308
See application file for complete search history.

(56) References Cited

U.S. PATENT DOCUMENTS 1,342,520 A * 6/1920 Wright ..... G09B 19/0007 273/296
1,355,782 A * 10/1920 Roy ..... A63F 1/02 273/306
1,357,166 A * 10/1920 Hart ..... A63F 1/02 273/303
4,570,939 A * 2/1986 Tourville ..... A63F 3/00075 273/253
5,104,127 A * 4/1992 Whitney ..... A63F 3/00006 273/243
5,112,059 A * 5/1992 Mundle ..... A63F 1/02 273/292
5,662,332 A * 9/1997 Garfield ..... A63F 1/00 273/308
6,254,099 B1 * 7/2001 Pederson ..... A63F 3/00075 273/262
6,948,938 B1 * 9/2005 Tseng ..... G09B 19/06 273/299
7,392,986 B2 * 7/2008 Gress ..... A63F 1/00 273/292
2002/0067000 A1 * 6/2002 Larson ..... A63F 3/00075 273/255
2005/0093229 A1 * 5/2005 Dewayne ..... A63F 1/00 273/146
2006/0033278 A1 * 2/2006 Conde ..... A63F 1/02 273/292
2007/0085485 A1 * 4/2007 Flickinger ..... H05B 37/0254 315/201
2008/0067748 A1 * 3/2008 Hollander ..... A63F 1/00 273/307
2008/0179831 A1 * 7/2008 Hollander ..... A63F 1/02 273/293

(Continued)

FOREIGN PATENT DOCUMENTS

CN 2048371 U * 11/1989

*Primary Examiner* — Aarti B Berdichevsky
*Assistant Examiner* — Dolores Collins
(74) *Attorney, Agent, or Firm* — Larson & Larson, P.A.; Frank Liebenow

(57) ABSTRACT

A deck of cards includes eighty four playing cards. Each playing card has a front surface and a back surface. The front surface of all of the playing cards has the same design. The eighty four playing cards include four sets of twenty one playing cards. Each of the four sets corresponds to a branch of military service and each playing card within each of the four sets of twenty one playing cards corresponding to a rank within a respective branch of the military service.

20 Claims, 18 Drawing Sheets

(56) References Cited

U.S. PATENT DOCUMENTS

| | | | | |
|---|---|---|---|---|
| 2008/0224407 | A1* | 9/2008 | Hollander | A63F 1/00 273/304 |
| 2010/0264595 | A1* | 10/2010 | Carey | A63F 1/04 273/308 |
| 2012/0282988 | A1* | 11/2012 | Martens | A63F 1/00 463/11 |

* cited by examiner

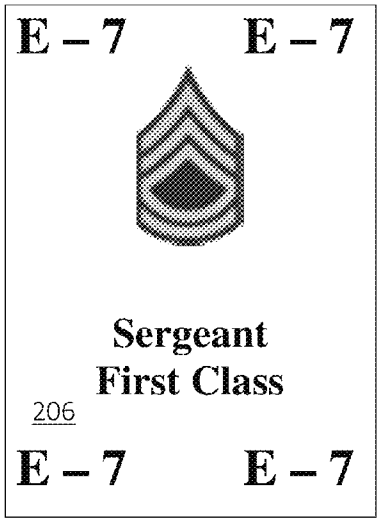
FIG. 28
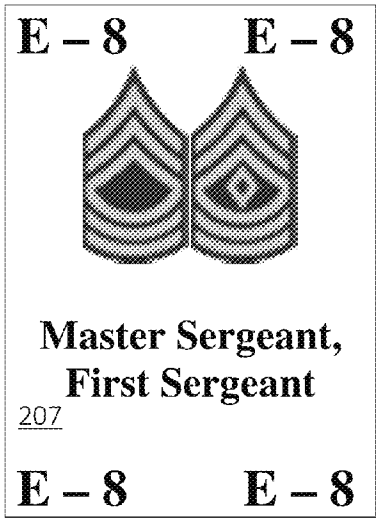
FIG. 29
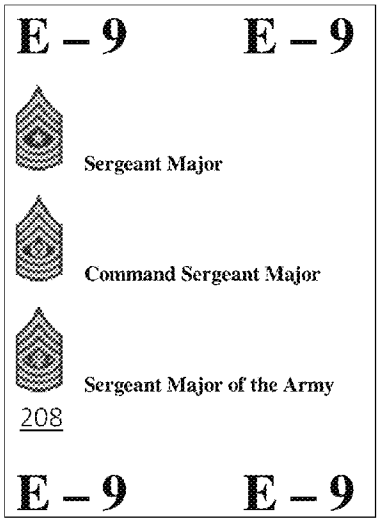
FIG. 30
FIG. 31
FIG. 32
FIG. 33

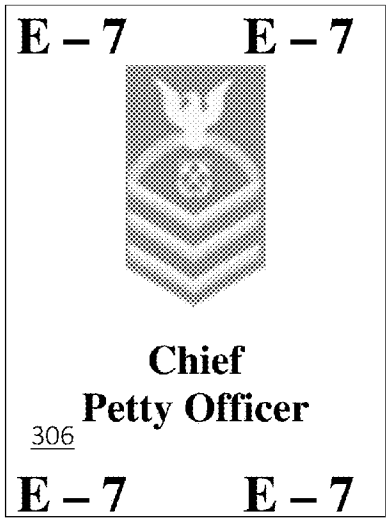
FIG. 49
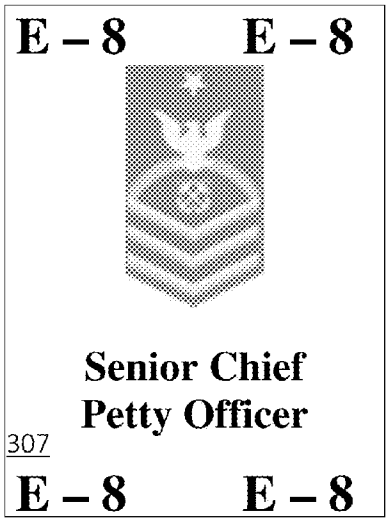
FIG. 50
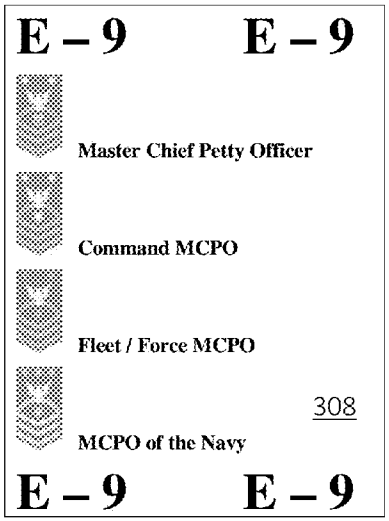
FIG. 51
FIG. 52
FIG. 53
FIG. 54

| | ARMY | NAVY |
|---|---|---|
| E-1 | PVT Private | SR Seaman Recruit |
| E-2 | PV2 Private 2 | SA Seaman Apprentice |
| E-3 | PFC Private First Class | SN Seaman |
| E-4 | SPC Specialist / CPL Corporal | PO3 Petty Officer, Thrid Class |
| E-5 | SGT Sergeant | PO2 Petty Officer, Second Class |
| E-6 | SSG Staff Sergeant | PO1 Petty Officer, First Class |
| E-7 | SFC Sergeant First Class | CPO Chief Petty Officer |
| E-8 | MSG / MSG-1SG Master Sergeant | SCPO Senior Chief Petty Officer |
| E-9 | SGM Sergeant Major | MCPO Master Chief Petty Officer |
| | CSM Command Sergeant Major | CMDCM Command MCPO |
| | SMA Sergeant Major of the Army | FORCM / FLTCM Force/Fleet MCPO |
| | | MCPON MCPO of the Navy |
| | NOTE: The WO card condenses all the Warrant Officer grades W-1 through W-5 | |
| W-1 | WO1 Warrant Officer 1 | N/A Discon'd 1975 |
| W-2 | CW2 Chief Warrant Officer 2 | CWO2 Chief Warrant Officer 2 |
| W-3 | CW3 Chief Warrant Officer 3 | CWO3 Chief Warrant Officer 3 |
| W-4 | CW4 Chief Warrant Officer 4 | CWO4 Chief Warrant Officer 4 |
| W-5 | CW5 Chief Warrant Officer 5 | CWO5 Chief Warrant Officer 5 |
| O-1 | 2LT Second Lieutenant | ENS Ensign |
| O-2 | 1LT First Lieutenant | LTJG Lieutenant Junior Grade |
| O-3 | CPT Captain | LT Lieutenant |
| O-4 | MAJ Major | LCDR Lieutenant Commander |
| O-5 | LTC Lieutenant Colonel | CDR Commander |
| O-6 | COL Colonel | CAPT Captain |
| O-7 | BG Brigadier General | RDML Rear Admiral (lower 1/2) |
| O-8 | MG Major General | RADM Rear Admiral (upper 1/2) |
| O-9 | LTG Lieutenant General | VADM Vice Admiral |
| O-10 | GEN General | ADM Admiral |
| O-11 | GOA General of the Army | FADM Fleet Admiral |

FIG. 85

| | AIR FORCE | MARINE CORPS |
|---|---|---|
| E-1 | AB Airman Basic | Pvt Private |
| E-2 | Amn Airman | PFC Private First Class |
| E-3 | A1C Airman First Class | LCpl Lance Corporal |
| E-4 | SrA Senior Airman | Cpl Corporal |
| E-5 | SSgt Staff Sergeant | Sgt Sergeant |
| E-6 | TSgt Technical sergeant | SSgt Staff Sergeant |
| E-7 | MSgt / MSgt-1stSgt Master Sergeant | GySgt Gunnery Sergeant |
| E-8 | SMSgt / SMSgt-1stSgt Senior MSgt | MSgt / MSgt-1stSgt Master Sergeant |
| E-9 | CMSgt Chief Master Sergeant | MGySgt Master Gunnery Sergeant |
| | CMSgt-1stSgt | SgtMaj Sergeant Major |
| | CCM Command CMSgt | SgtMajMarCor Sgt Maj of the M.C. |
| | CMSAF CMSgt of the Air Force | |
| | NOTE: The WO card condenses all the Warrant Officer grades W-1 through W-5 | |
| W-1 | ALL N/A Discon'd 1959 | WO Warrant Officer |
| W-2 | N/A | CWO2 Chief Warrant Officer 2 |
| W-3 | N/A | CWO3 Chief Warrant Officer 3 |
| W-4 | N/A | CWO4 Chief Warrant Officer 4 |
| W-5 | N/A | CWO5 Chief Warrant Officer 5 |
| O-1 | 2dLt | 2ndLt |
| O-2 | 1stLt | 1stLt |
| O-3 | Capt | Capt |
| O-4 | Maj | Maj |
| O-5 | LtCol | LtCol |
| O-6 | Col | Col |
| O-7 | BrigGen | BGen |
| O-8 | MajGen | MajGen |
| O-9 | LtGen | LtGen |
| O-10 | Gen | Gen |
| O-11 | GOAF General of the Air Force | N/A |

FIG. 86

MILITARY-BASED GAMING SYSTEM

FIELD

This invention relates to the fields of entertainment and learning; and more particularly to a system, method, and apparatus for playing a game using cards having military-based backs.

BACKGROUND

There are many types of cards and card games available. The best known type of cards is commonly referred to as "playing cards," consisting of 52 unique cards having four suits (clubs, diamonds, hearts, and spades) with 13 cards in each suit (Ace, 2-10, Jack, Queen, King). Although various sizes and styles of playing cards exist, they all share these similar characteristics. Using such playing cards, people pass the time playing various games such as poker, gin rummy, war, canasta, bridge, etc.

Other types of cards with similar or different playing styles have been introduced, in particular those for playing old maid, or children's games of concentration, etc. One company markets a specific deck of cards having four colors instead of suits and special purpose cards that skip the next player, make the next player draw two cards, etc.

All of these card sets and games have great entertainment value, but are mostly limited to entertainment, providing minimal educational opportunities.

There are thousands of individuals joining the military every week. Many of these individuals have time that needs to be occupied and often, cards are a superior way of occupying such time, as they are portable and quite ubiquitous. Again, there is a lack of educational value, and these cards and games provide solely entertainment.

At the same time, these thousands of military personnel, being new to the military, need to understand the various ranks of the military. Further, when approached by a military person from another branch of the military, it is also important for these military personnel to understand the ranks of the other branches and how they relate to the ranks within their own branch.

What is needed is a gaming system that will provide entertainment value while teaching military personnel the ranks.

SUMMARY

A deck of game playing cards is disclosed containing approximately 84 playing cards. Each card has a back side which is similar to each of the other playing cards such that the cards cannot be distinguished by observing the back side. A front side of each card contains an indication of military branch and rank, such that various card games are played using such indication to determine which card out-plays which other card. By having 84 playing cards, an equal number of cards is dealt to two players (42 playing cards to each player), three players (28 playing cards to each player), and four players (21 playing cards to each player).

In one embodiment, a deck of cards is disclosed including a plurality of playing cards. Each playing card of the plurality of playing cards has a front surface and a back surface. The front surface of all of the playing cards of the plurality of playing cards has a same design. The back surface of each of the playing cards has indicia indicating a branch of military service and a rank within the military service. In this, each individual playing card of the of the plurality of playing cards is unique with respect to the other playing cards of the plurality of playing cards.

In another embodiment, a deck of cards is disclosed including a first set of playing cards. Each playing card of the first set of playing cards has a front surface and a first back surface. The front surface of all of the playing cards of the first set of playing cards has a same design. The first back surface of each of the playing cards has indicia indicating a first branch of military service and a rank within the first branch of military service. In such, each individual playing card of the of the first set of playing cards is unique with respect to the other playing cards of the first set of playing cards.

In another embodiment, a deck of cards is disclosed including eighty four playing cards. Each playing card has a front surface and a back surface. The front surface of all of the playing cards has the same design. The eighty four playing cards include four sets of twenty one playing cards. Each of the four sets corresponds to a branch of military service and each playing card within each of the four sets of twenty one playing cards corresponding to a rank within a respective branch of the military service.

BRIEF DESCRIPTION OF THE DRAWINGS

The invention can be best understood by those having ordinary skill in the art by reference to the following detailed description when considered in conjunction with the accompanying drawings in which:

FIG. 85 illustrates a chart of playing cards for the army and navy military branches.

FIG. 86 illustrates a chart of playing cards for the air force and marine military branches.

DETAILED DESCRIPTION

Figure 1:
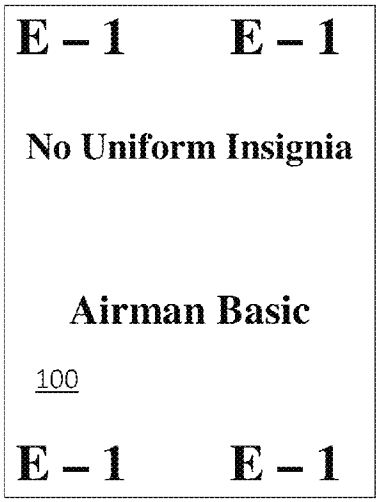
FIGS. 1-84 illustrate a schematic view of a front design of individual playing cards.

Reference will now be made in detail to the presently preferred embodiments of the invention, examples of which are illustrated in the accompanying drawings. Throughout the following detailed description, the same reference numerals refer to the same elements in all figures.

Although specific emblems are shown for each rank and respective branch of military service, it is anticipated that in some embodiments, other emblems are utilized; depending upon the military structure of a particular country and, therefore, the style and configuration of each particular playing card will depict a specific branch and rank within that branch of such a military structure.

Throughout the description, the playing card backs are shown including ranks and branch of service. As it is well known, the playing card fronts are typically homogeneous such that it is difficult to impossible to tell one playing card from another playing card by looking at the card fronts, therefore allowing users to play games in which they do not know what subset of the playing cards is possessed by their opponents. Generally, such playing cards are thin, cardboard or plastic stock with the ranks and military branches on the card backs and a decorative pattern on the card fronts.

Figure 2:
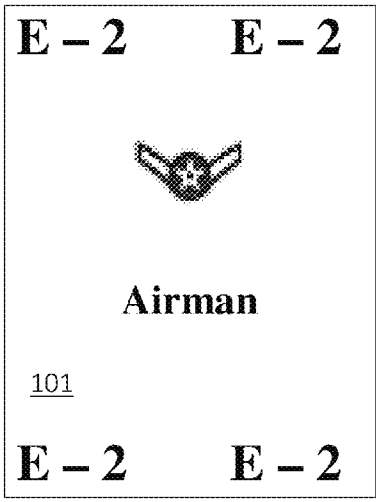
Figure 3:
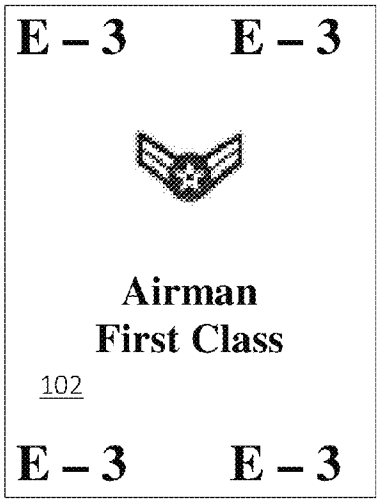
Figure 4:
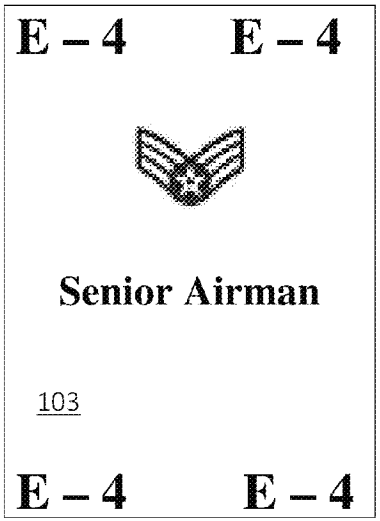
Figure 5:
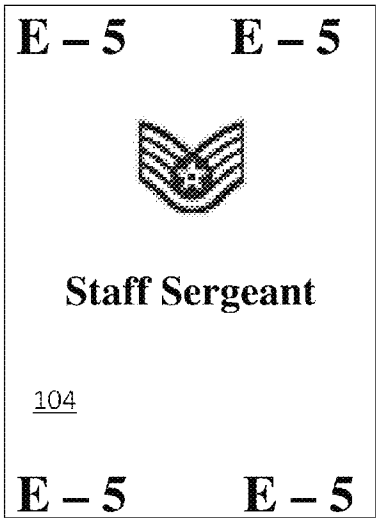
Figure 84:
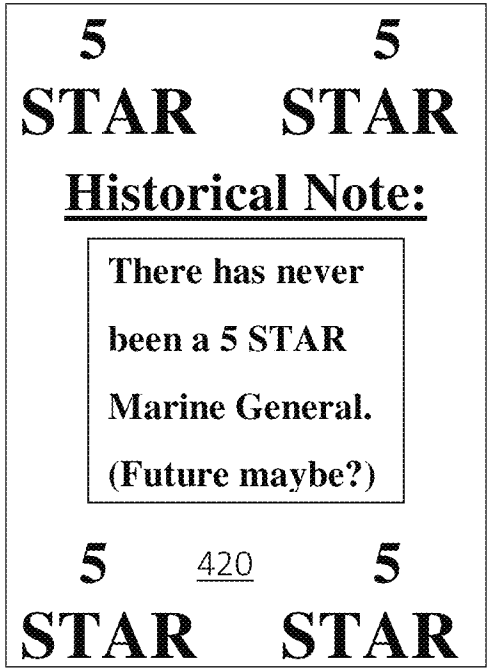

Referring to FIGS. 1-84, the card backs of a sample set of playing cards 100-120/200-220/300-320/400-420 are shown. The indicia on each card 100-120/200-220/300-320/400-420 represents a particular rank and branch of military service. In some embodiments, the indicia include an insignia for the particular rank and branch of military service. For example, in FIG. 2, the indicia of the second playing card

Figure 6:
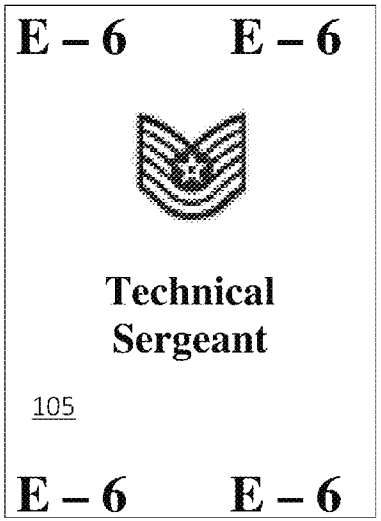
Figure 7:
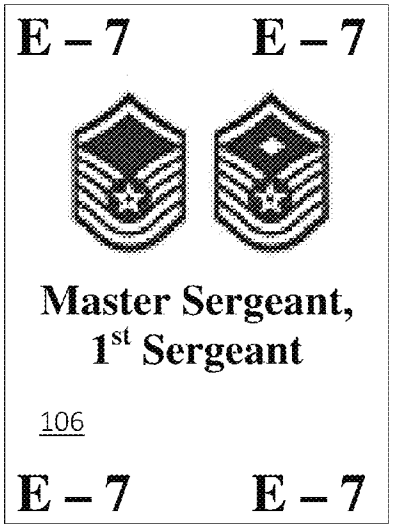
Figure 8:
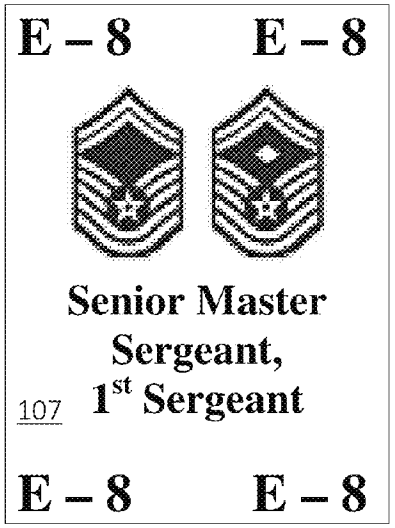
Figure 9:
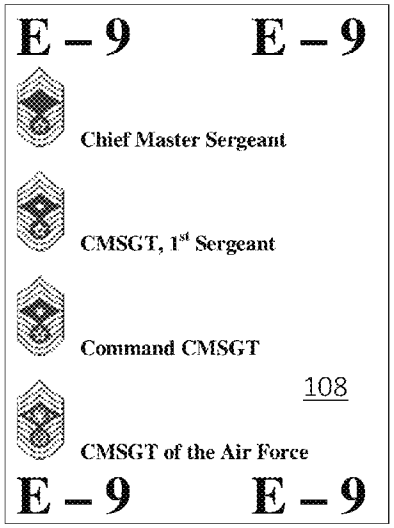
Figure 10:
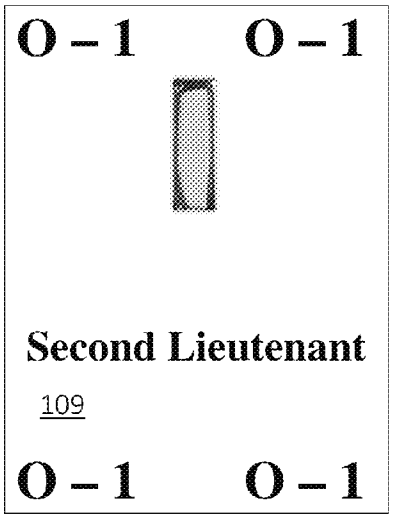
Figure 11:
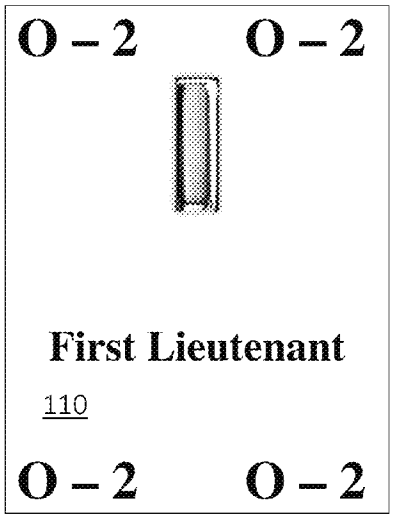
Figure 12:
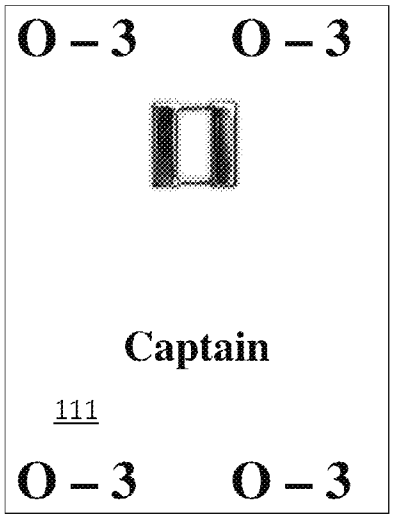
Figure 13:
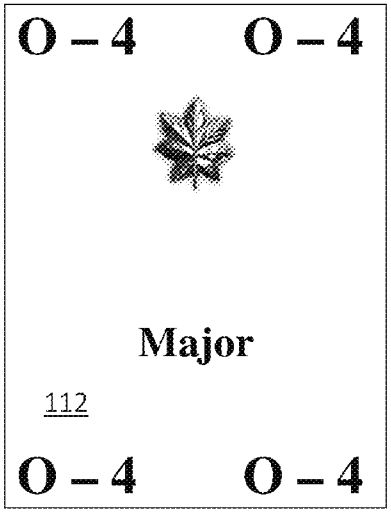
Figure 14:
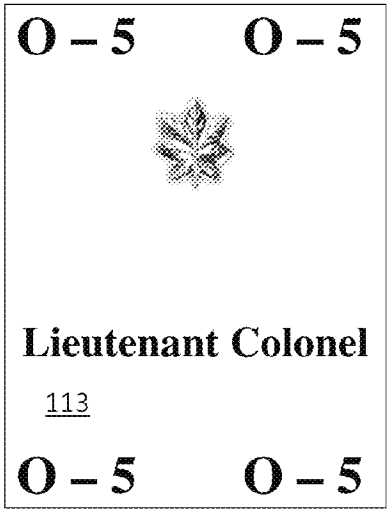
Figure 15:
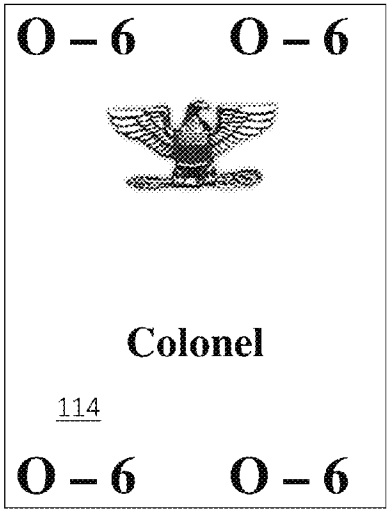
Figure 16:
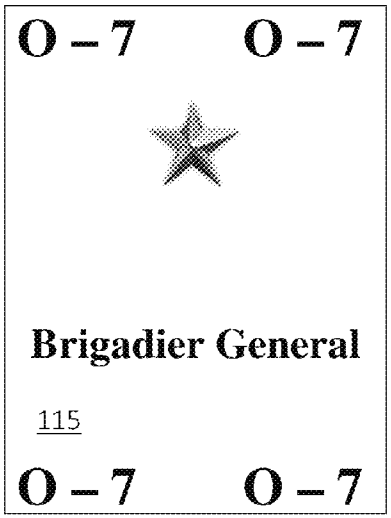
Figure 17:
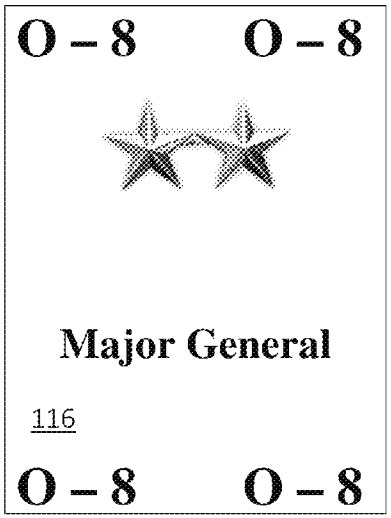
Figure 18:
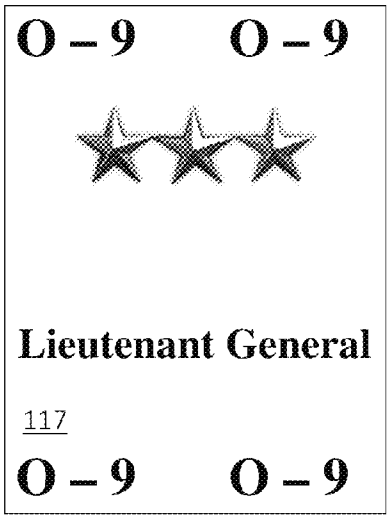
Figure 19:
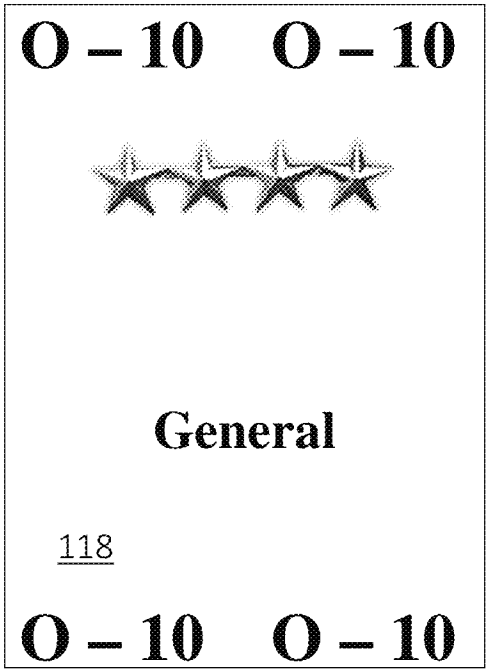
Figure 20:
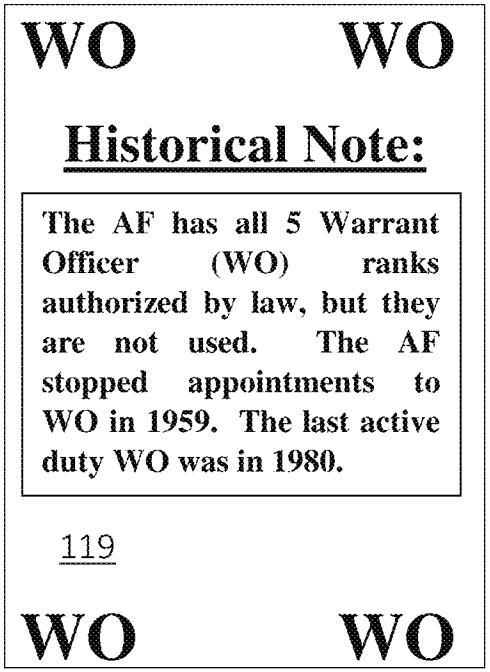
Figure 21:
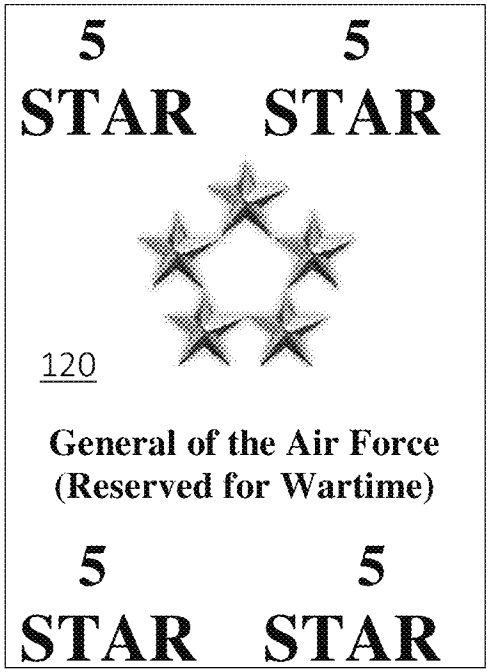
Figure 22:
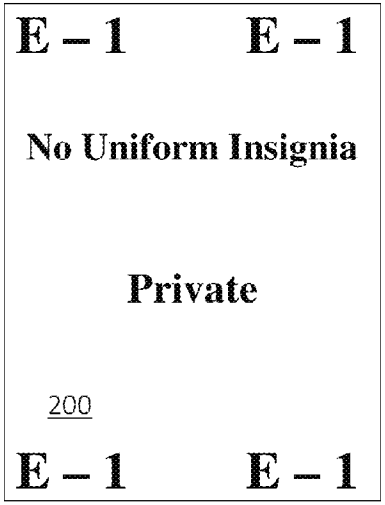
Figure 23:
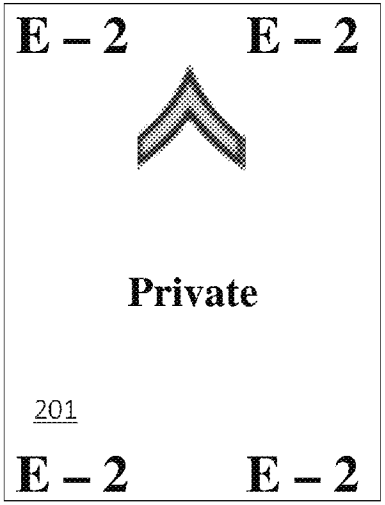
Figure 24:
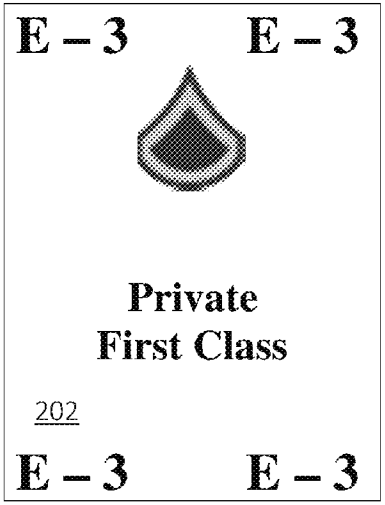
Figure 25:
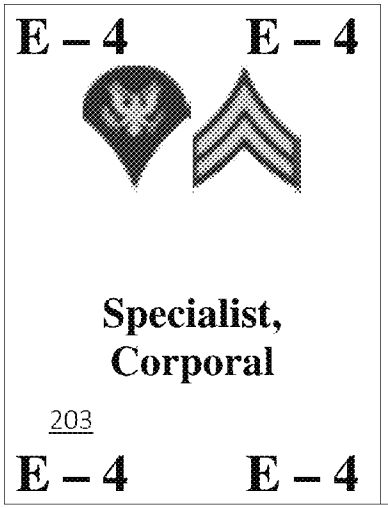
Figure 26:
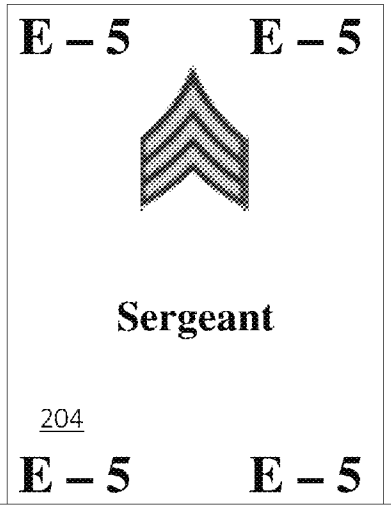
Figure 27:
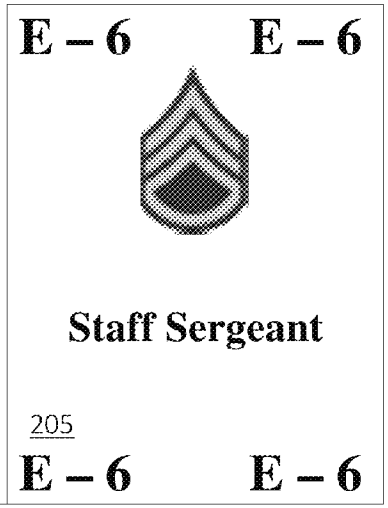
Figure 34:
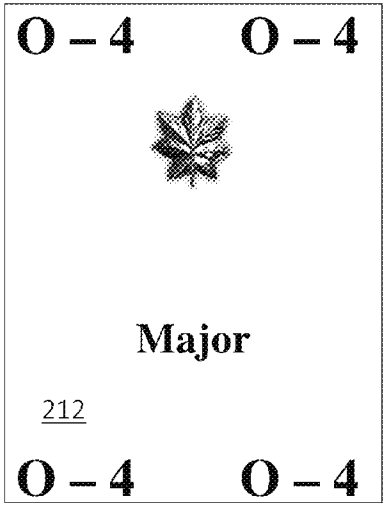
Figure 35:
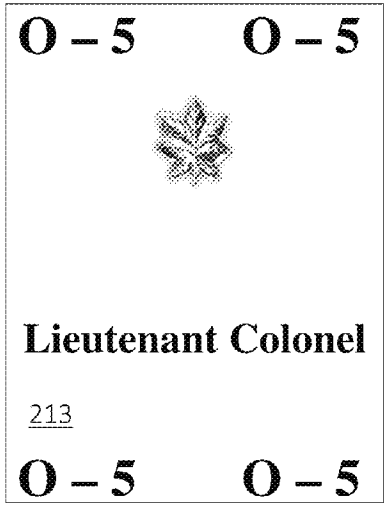
Figure 36:
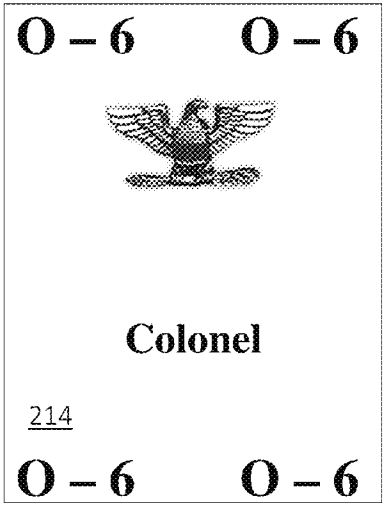
Figure 37:
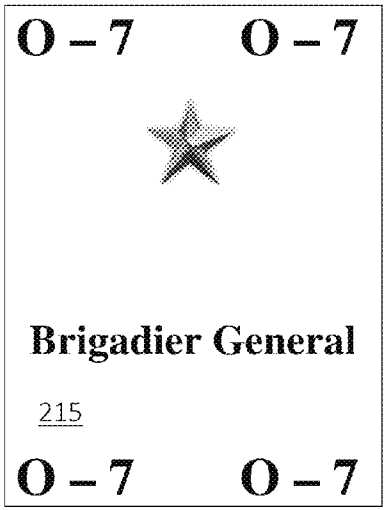
Figure 38:
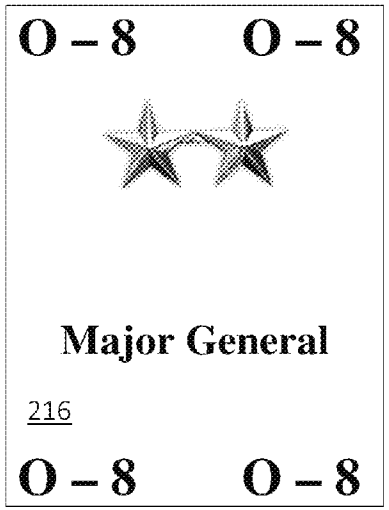
Figure 39:
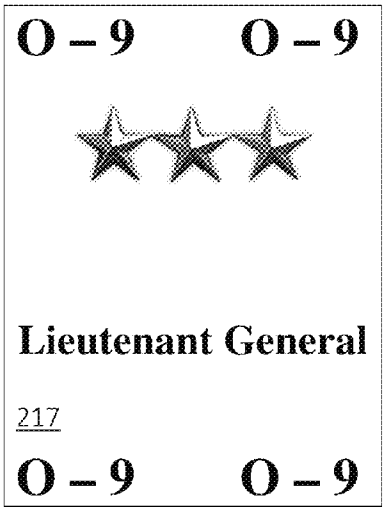
Figure 40:
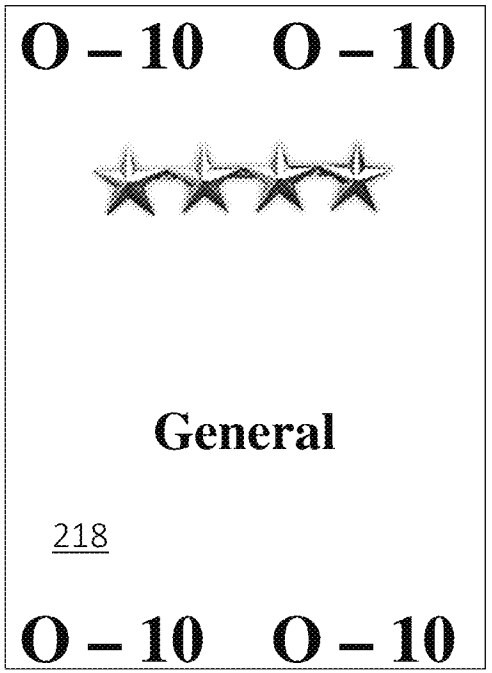
Figure 41:
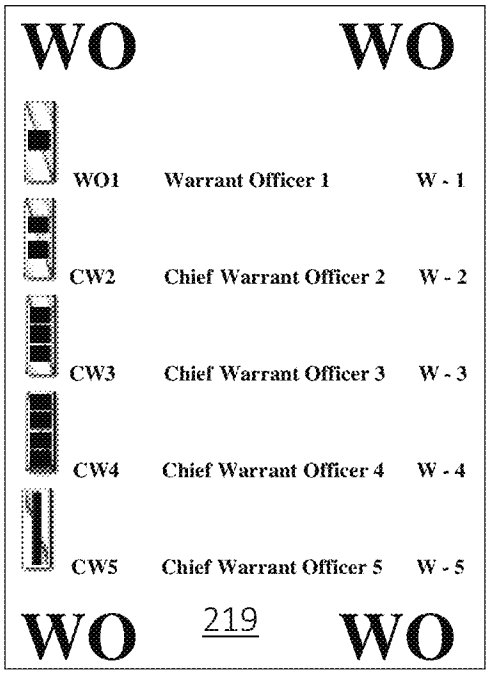
Figure 42:
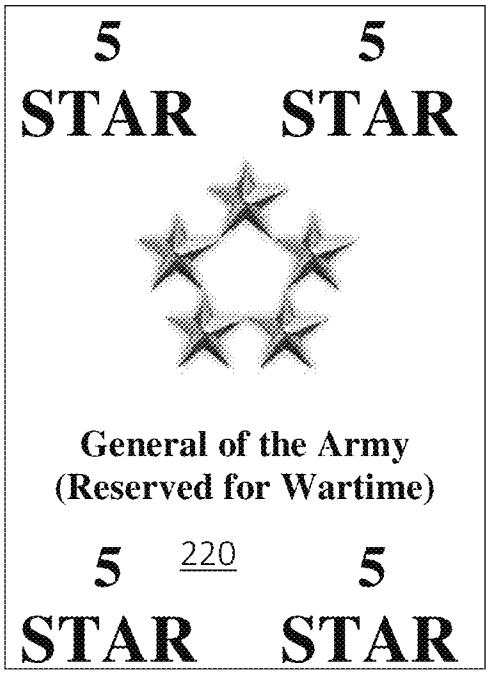
Figure 43:
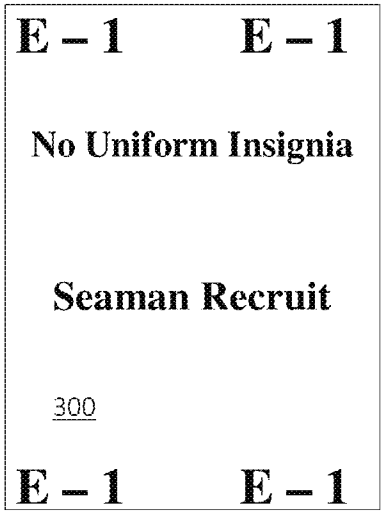
Figure 44:
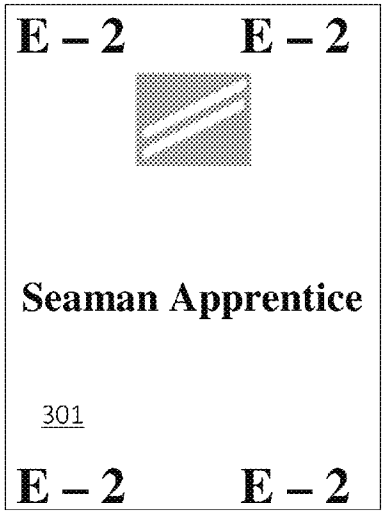
Figure 45:
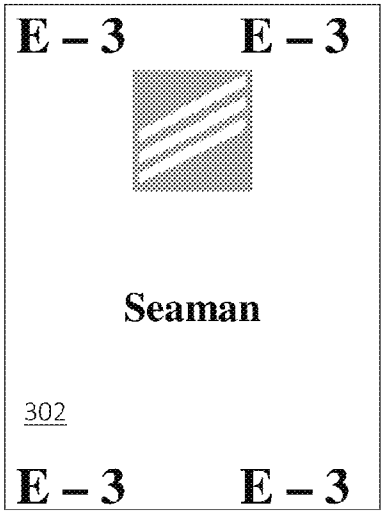
Figure 46:
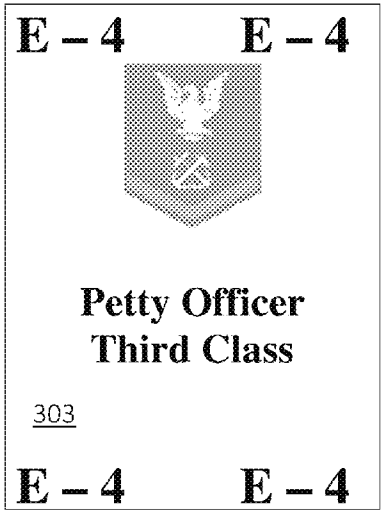
Figure 47:
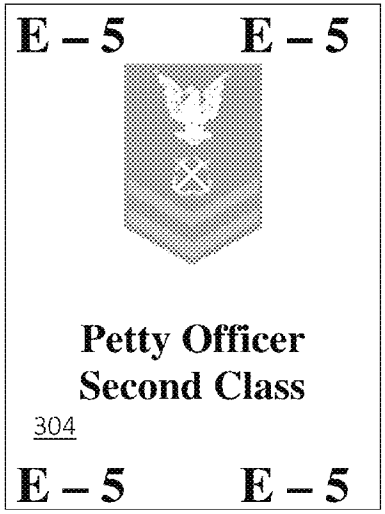
Figure 48:
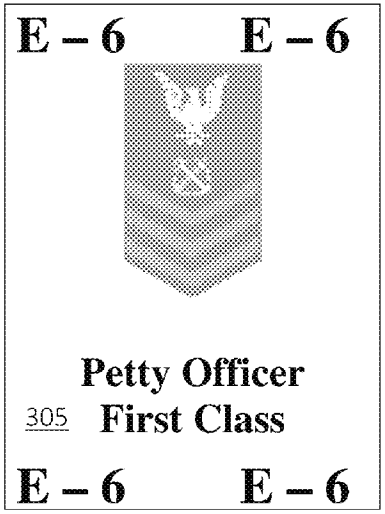
Figure 55:
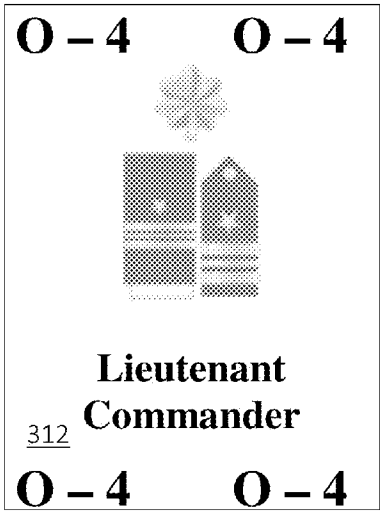
Figure 56:
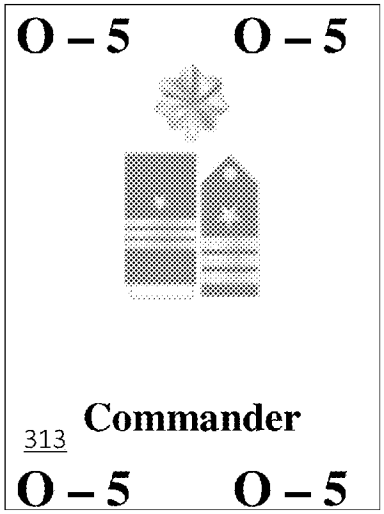
Figure 57:
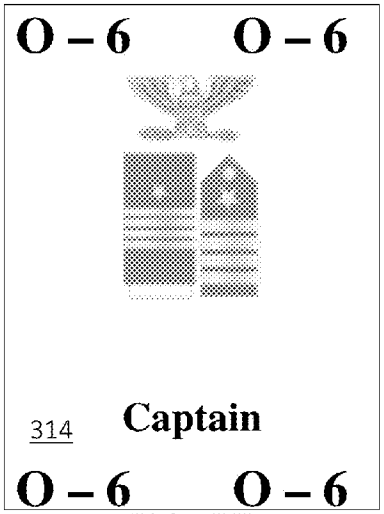
Figure 58:
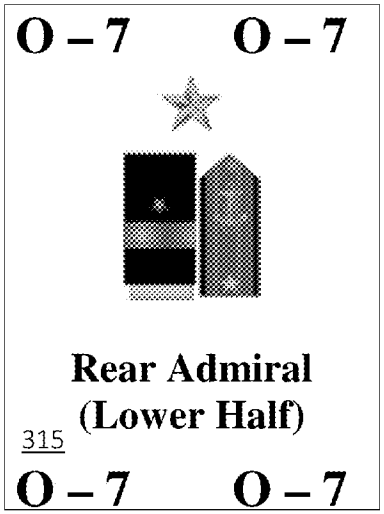
Figure 59:
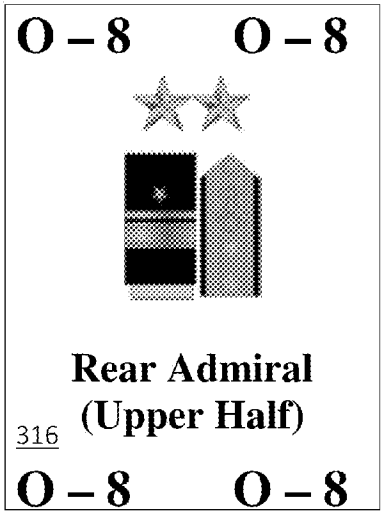
Figure 60:
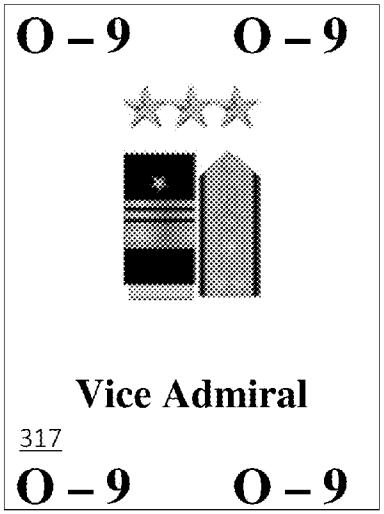
Figure 61:
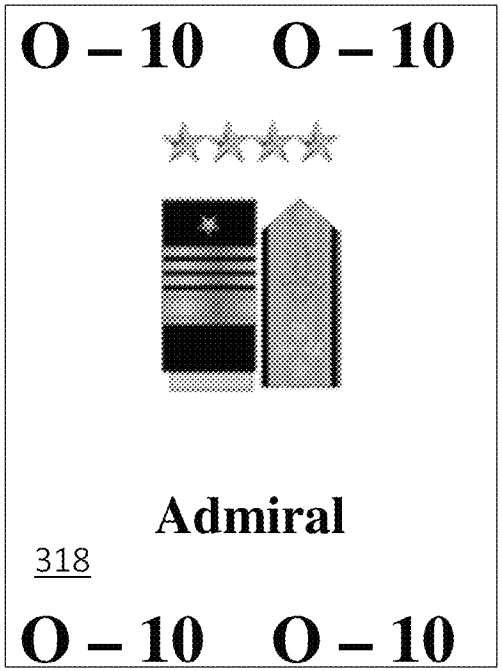
Figure 62:
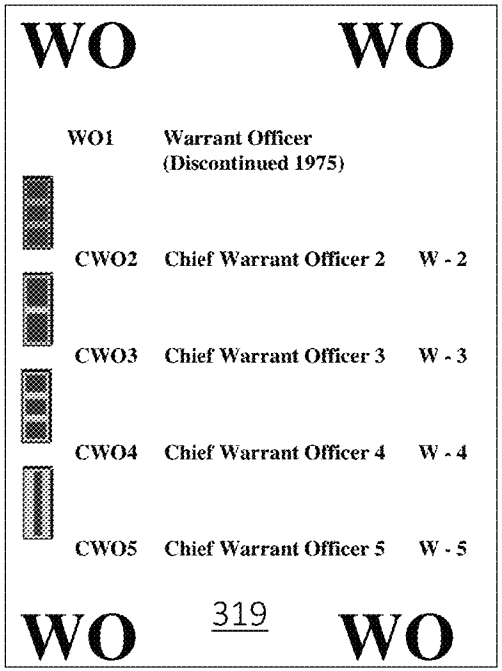
Figure 63:
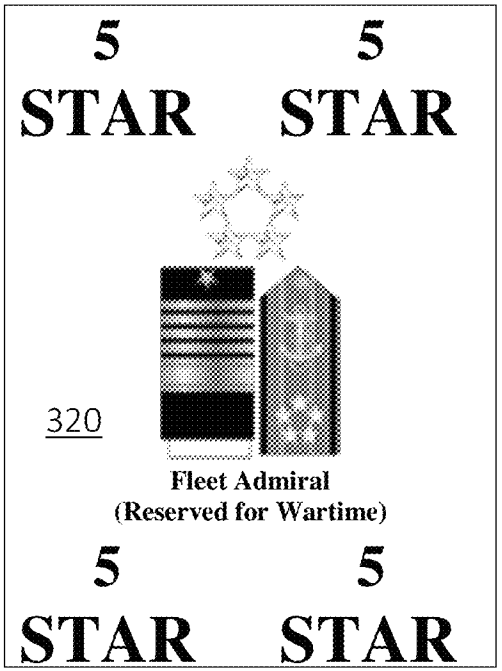
Figure 64:
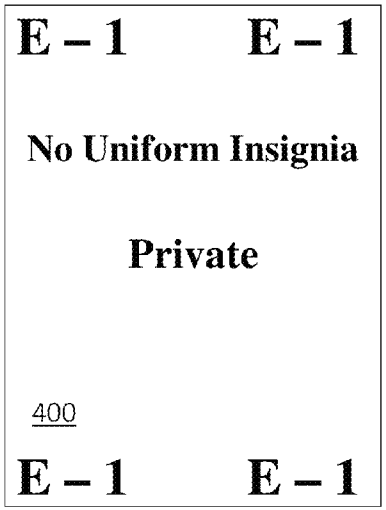
Figure 65:
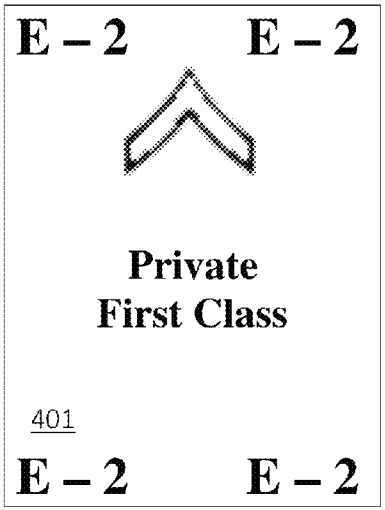
Figure 66:
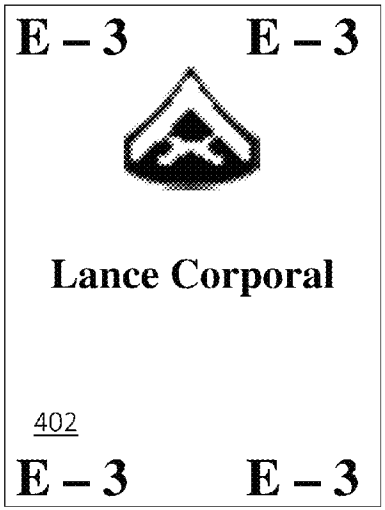
Figure 67:
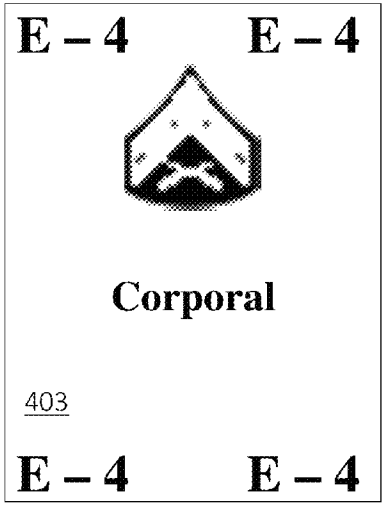
Figure 68:
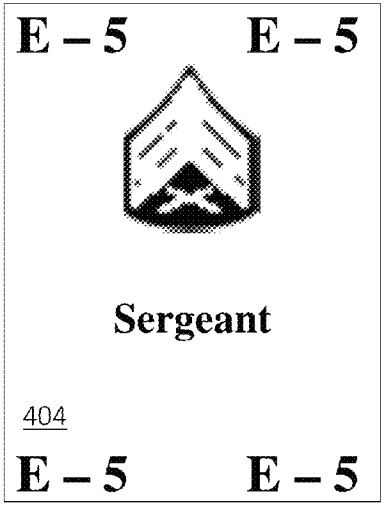
Figure 69:
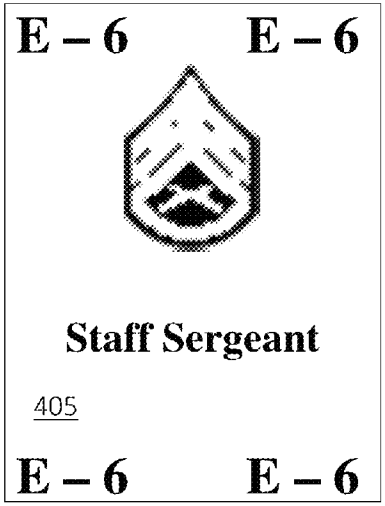
Figure 70:
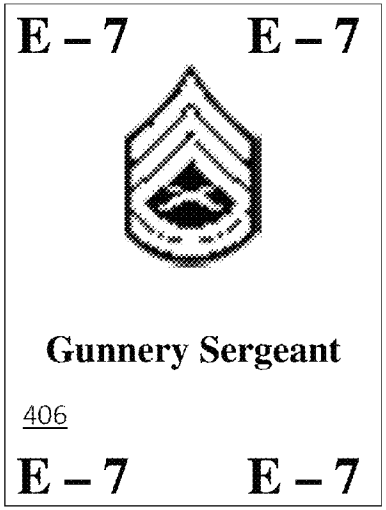
Figure 71:
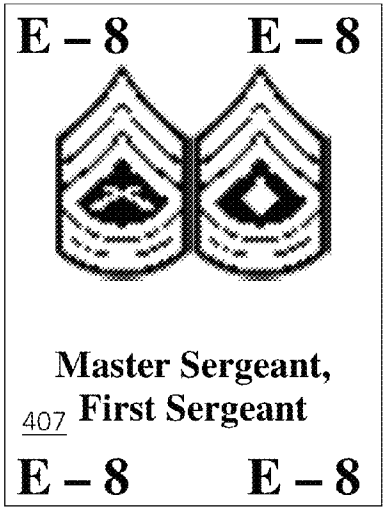
Figure 72:
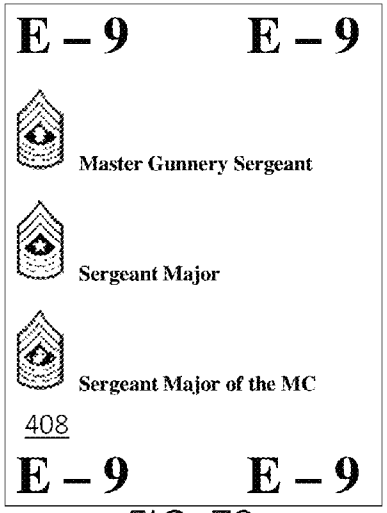
Figure 73:
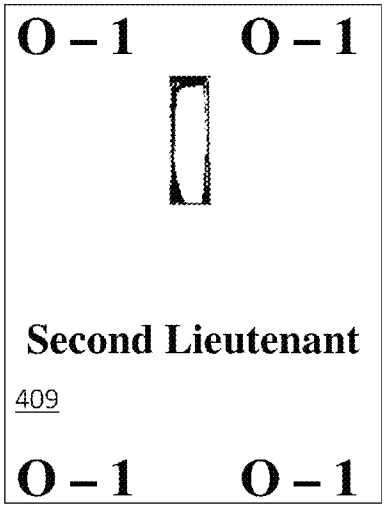
Figure 74:
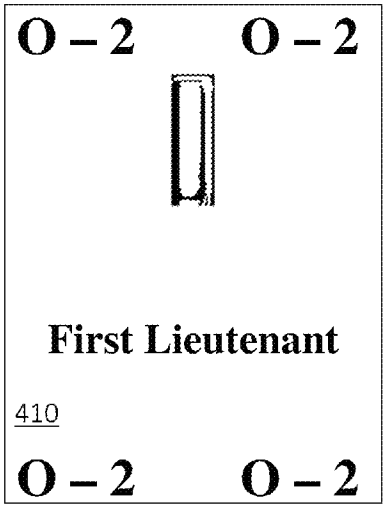
Figure 75:
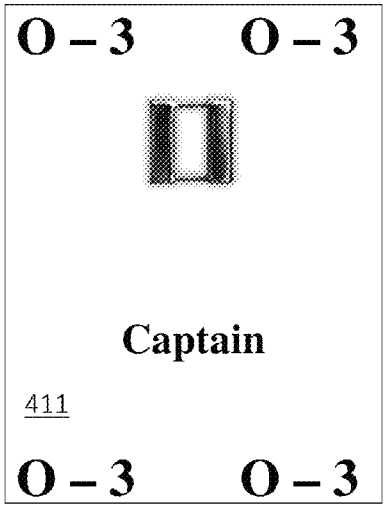
Figure 76:
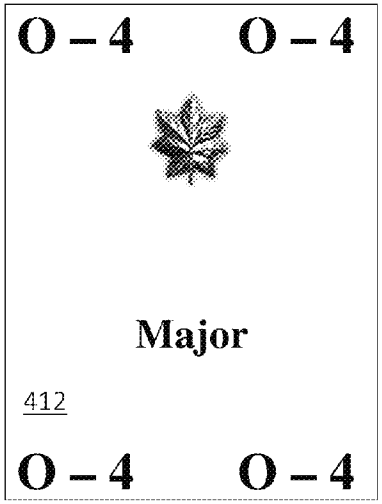
Figure 77:
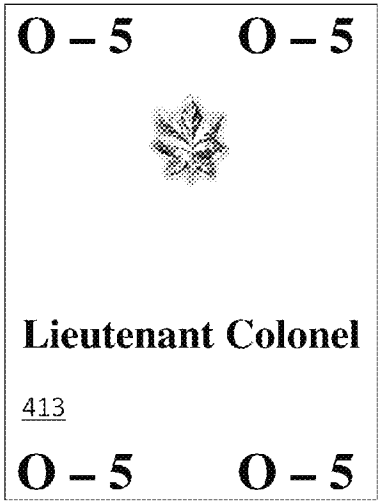
Figure 78:
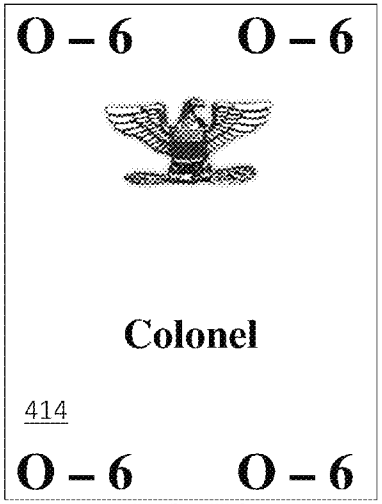
Figure 79:
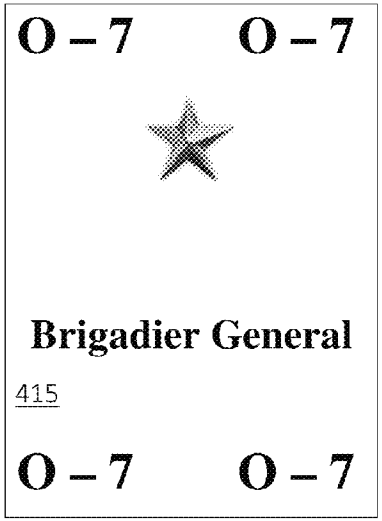
Figure 80:
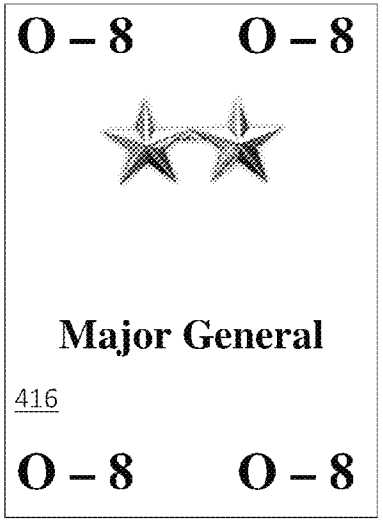
Figure 81:
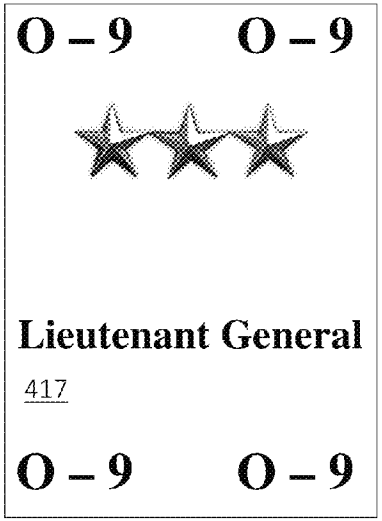
Figure 82:
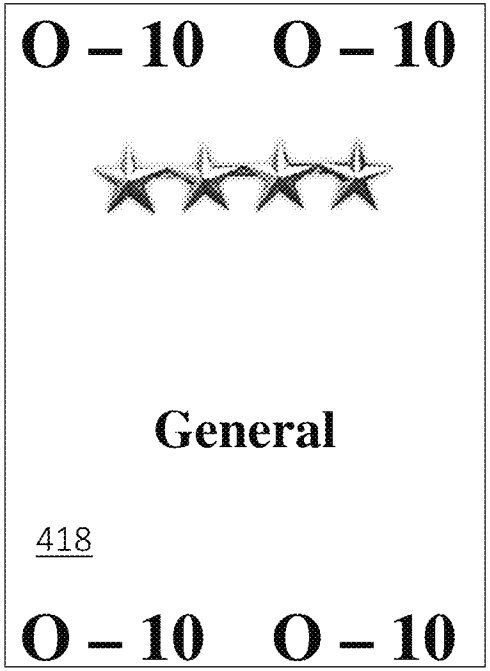
Figure 83:
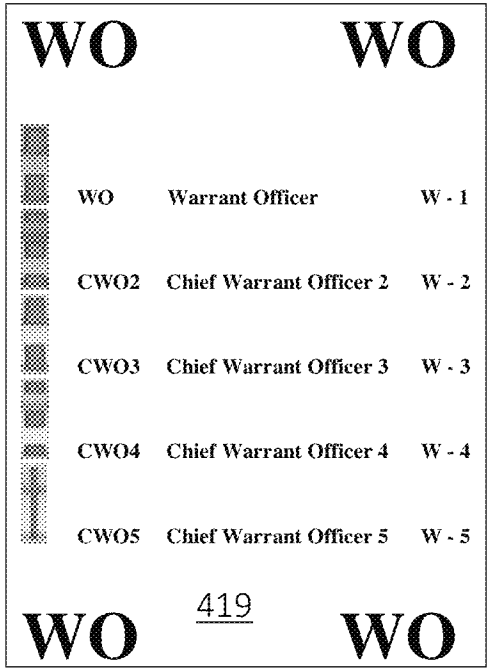

101 indicate an Airman E-2 in the air force of a particular country such as the United States of America. In contrast, in FIG. 6, the indicia of the sixth playing card 105 indicate a Technical Sergeant E-6 in the air force of that particular country.

When using the playing cards 100-120/200-220/300-320/400-420, in general, the higher the rank, the more powerful or useful the card. As an example, playing a war-like game, the Technical Sergeant E-6 playing card 105 would take/capture (overpower) the Airman E-2 playing card 101. Further, to differentiate suits, each branch of the military service corresponds to a particular suit for playing games that differentiate between suits (e.g., Pinochle, Bridge, Euchre, etc.), similar to that of clubs, diamonds, hearts and spades would be air force, army, marines, and navy, etc.

Referring to FIGS. 85 and 86, the overall ordering of all playing cards is listed, the playing card at the top of the list typically has the lowest value and the playing card at the bottom of the list typically has the highest value. Such typical value is determined by the game that is being played. For example, in a standard game of "war," the general will overtake the private, but in other games such as Euchre and Pinochle, there are roles for certain cards (e.g. a card that matches a Jack in Euchre or a military branch that is declared triumph in Pinochle). The ranks mimic card numbers in a standard 52 card deck while the military branch mimics a suit in a standard 52 card deck, though the number of cards is different as well as the design to promote learning of military ranks and branches.

Although four military branches are disclosed (air force, army, marines, navy), more or less branches are anticipated depending upon the military structure of a country. For example, it is anticipated that a fifth branch is added for a national guard, or in some land-locked countries, there is no navy, etc.

The disclosed set of playing cards 100-120/200-220/300-320/400-420 are suitable for playing many different games while identifying the grade/rank/title/insignia of members of the military. In one example, the military is divided into four branches as in the United States: US Army, US Navy, US Air Force, and US Marine Corps. In the examples and a preferred embodiment, the playing cards 100-120/200-220/300-320/400-420 are suited based upon each of the four branches, a first suit being the air force cards 100-120, the second suit being the army cards 200-220, the third suit being the navy cards 300-320, and the fourth suit being the marine cards 400-420.

Pay grades are used by the uniformed military services of the United States to determine wages and benefits based on the corresponding military rank of a member of the services. The pay grades of the uniformed military services of the United States are uniform and equivalent between all the branches. In the uniformed military services of the United States, the pay grades are used to quickly determine seniority among a group of members from the different service branches.

The pay grades translate to equivalent ranks that are used by the uniformed military services of the United States to distinguish between the different rank levels, and set hierarchy in the chain of command. The ranks have corresponding titles and insignia assigned to them to identify a member's standing, and establish responsibilities and duties in their organization, and also their corresponding form of address. The disclosed set of playing cards 100-120/200-220/300-320/400-420 include the pay grades and corresponding insignia to familiarize users of such as to the pay grades and insignia of that user's branch as well as the other branches of the military.

In some embodiments, the disclosed set of playing cards 100-120/200-220/300-320/400-420 is used as flashcards to learn to identify military grades/ranks/titles/insignia. In some embodiments, the disclosed set of playing cards 100-120/200-220/300-320/400-420 is used to play various card games. One anticipated card game is "war," similar to the game played with a standard deck of cards. Another anticipated card game is crazy Colonels/crazy Chiefs (similar to crazy 8s). Another anticipated card game is Solitaire. Poker games and such are anticipate. In some such games, there are times that certain cards are removed from the set of playing cards 100-120/200-220/300-320/400-420, for example, removing the General cards 120/220/320/420 to change the set of playing cards 100-120/200-220/300-320/400-420 to better simulate a standard deck of cards.

Using the set of playing cards 100-120/200-220/300-320/400-420, a new form of the old game of war is anticipated, called here within, "warr." The game strategy is similar and promotes recognition of which of two cards is higher in grade/rank.

In the basic game of "warr," there are two players and the full set of playing cards 100-120/200-220/300-320/400-420 is used. The set of playing cards 100-120/200-220/300-320/400-420 is divided evenly among players, so, for example, if there are two players, each player receives 42 cards. Players do not look at their cards, but keep them in a stack face down. The object of the game is to win all the cards.

Play progresses as in the original game of "war," with the E-1 card 100/200/300/400 being the lowest value and the 5-star card 120/220/320/420 being the highest. Each player turns up one card 100-120/200-220/300-320/400-420 at a time and whichever player has the highest value card 100-120/200-220/300-320/400-420 captures all the other cards 100-120/200-220/300-320/400-420.

Suits are ignored in the game of "warr."

If any of the cards 100-120/200-220/300-320/400-420 that are turned up have an equal rank, a war is declared. To determine a winner, the players set aside the next three cards 100-120/200-220/300-320/400-420 of their pile face down and turn up a fourth card 100-120/200-220/300-320/400-420. Whoever has the higher rank of the fourth card 100-120/200-220/300-320/400-420 wins the war and adds the cards 100-120/200-220/300-320/400-420 to their stack. If the fourth card 100-120/200-220/300-320/400-420 are of equal rank, the war continues, repeating the above steps.

The game continues until one player has all the cards and wins the "WARR." If a player runs out of cards during a war, their last card 100-120/200-220/300-320/400-420 is turned face up and is used for all battles in that war series. The wars continues until the player with no cards loses the last war, and thus all their cards 100-120/200-220/300-320/400-420, or they win the war to collect the played card fourth card 100-120/200-220/300-320/400-420 and play then continues.

In a variation possible with the disclosed set of cards 100-120/200-220/300-320/400-420, when a player turns up a 5-STAR card 120/220/320/420, another has a chance to overcome it. The other player turns up two more cards 100-120/200-220/300-320/400-420 face up to declare a nuclear option. To defeat or "nuke" the first player's 5-STAR card 120/220/320/420, the 3 up-turned cards taken together must include more than 5 stars. For example, the 3 up-turned cards include a 4-STAR card 118/218/318/418 and a 2-STAR card 116/216/316/416, or in another example, the 3 up-turned cards include a 4-STAR card 118/218/318/418 and two 1-STAR cards 115/215/315/415. Any combination that includes more than 5 stars allows the other player to beat (and take) the first player's 5-STAR card 120/220/320/420. If one of the cards 100-120/200-220/300-320/400-420 turned up by the other player is a 5-STAR card 120/220/320/420, a war is declared (as above).

When more than two players are involved, each simultaneously turns over a card 100-120/200-220/300-320/400-420 and the highest card 100-120/200-220/300-320/400-420 wins all cards 100-120/200-220/300-320/400-420 that are tuned up. If two or more cards 100-120/200-220/300-320/400-420 have the highest rank and match in rank, there is a war. In some variations of the game, all players will take part in this war, not only the ones who had the highest cards.

The Nuclear Option to defeat a 5-STAR card 120/220/320/420 also applies, and like a war, in some variations of the game, all players will take part. In such, it is anticipated that getting six or more stars be accomplished by the two or more opponent players. For example, there's a tie between two players with seven stars total for each. One player has a 4-STAR card 118/218/318/418 and a 3-STAR card 117/217/317/417, while the other player has a 4-STAR card 118/218/318/418, a 2-STAR card 116/216/316/416, and a 1-STAR card 115/215/315/415. In this example, the player with the 4-STAR card 118/218/318/418 and the 3-STAR card 117/217/317/417 wins the war, since their 3-STAR card 117/217/317/417 outranks the other player's 2-STAR card 116/216/316/416 and 1-STAR card 115/215/315/415. The higher ranked cards take precedence. Only if the 5-STAR cards 120/220/320/420 matched, a war is fought out, with all the players then participating until a clear winner emerges, and wins all the cards 100-120/200-220/300-320/400-420 played.

Equivalent elements can be substituted for the ones set forth above such that they perform in substantially the same manner in substantially the same way for achieving substantially the same result.

It is believed that the system and method as described and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. A method of playing a game, the method comprising:

providing a deck of playing cards, each playing card in the deck of playing cards having a front surface and a back surface, the front surface of all of the playing cards in the deck of playing cards having a same design, and the back surface of each of the playing cards having indicia indicating a branch of military service and a rank within the military service; whereas each of the playing card in the deck of playing cards is unique with respect to the other playing cards in the deck of playing cards;

dealing out a number of the playing cards; and determining if a first playing card has a higher value than a second playing card determined by comparing the indicia indicating the rank within the military service on the back surface of the first playing card to the indicia indicating the rank within the military service on the back surface of the second playing card, wherein the rank is one of E1, E2, E3, E4, E5, E6, E7, E8, E9, WO, O1, O2, O3, O4, O5, O6, O7, O8, O9, O10, and O11/5-star general, in order of value lowest to highest.

2. The method of claim 1, wherein the branches of the military service are four branches.

3. The method of claim 1, wherein the four branches comprise an army, an air force, a marines, and a navy.

4. The method of claim 1, wherein the rank corresponds to a pay grade within the military service.

5. The method of claim 1, wherein the game is war, the method further comprising the step of: if the step of comparing determines that the rank of the first card is higher than the rank of the second card, then the first card wins.

6. The method of claim 5, the method further comprising the step of: if the step of comparing determines that the rank of the first card is equal to the rank of the second card, then a war is declared.

7. The method of claim 1, wherein the indicia further comprises an emblem that corresponds to the branch of the military service and to the rank.

8. The method of claim 1, wherein the deck of playing cards comprises a set of 84 of the playing cards.

9. A method of playing a game, the method comprising:

providing a deck of playing cards, each playing card in the deck of playing cards having a front surface and a back surface, the front surface of all of the playing cards in the deck of playing cards having a same design, and the back surface of each of the playing cards having indicia indicating a branch of military service and a rank within the military service; whereas the indicia of each of the playing cards in the deck of playing cards is unique with respect to the other playing cards in the deck of playing cards, the rank within the military service selected from the group consisting of E1, E2, E3, E4, E5, E6, E7, E8, E9, WO, O1, O2, O3, O4, O5, O6, O7, O8, O9, O10, and O11/5-star general;

dealing out a number of the playing cards; and determining if a first playing card has a higher value than a second playing card determined by comparing the indicia indicating the rank within the military service on the back surface of the first playing card to the indicia indicating the rank within the military service on the back surface of the second playing card, wherein the rank is one of E1, E2, E3, E4, E5, E6, E7, E8, E9, WO, O1, O2, O3, O4, O5, O6, O7, O8, O9, O10, and O11/5-star general, in order of value lowest to highest.

10. The method of claim 9, wherein the rank corresponds to a pay grade within a corresponding military service.

11. The method of claim 9, wherein the indicia further comprises an emblem that corresponds to the branch of the military service and to the rank.

12. The method of claim 9, wherein the branch of military service is selected from the group consisting of an army, an air force, a marines, and a navy.

13. The method of claim 9, wherein the game is war, the method further comprising the step of: if the step of comparing determines that the rank of the first card is higher than the rank of the second card, then the first card wins.

14. The method of claim 13, the method further comprising the step of: if the step of comparing determines that the rank of the first card is equal to the rank of the second card, then a war is declared.

15. A method of playing a game, the method comprising:

providing a deck of eighty four playing cards, each playing card in the deck of playing cards having a front surface and a back surface, the front surface of all of the playing cards in the deck of playing cards having a same design, and the back surface of each of the playing cards having indicia indicating a branch of military service and a rank within the military service; whereas the indicia of each of the playing cards in the deck of playing cards is unique with respect to the other playing cards in the deck of playing cards, the rank within the military service selected from the group consisting of E1, E2, E3, E4, E5, E6, E7, E8, E9, WO, O1, O2, O3, O4, O5, O6, O7, O8, O9, O10, and O11/5-star general;

dealing out all of the playing cards with the front surface up, distributing the playing cards to all players playing the game into a stack for each player;

each player exposing a top playing card of the stack associated with that player;

determining which of the exposed playing cards has the highest value by comparing the indicia indicating the rank within the military service on the back surface of the exposed playing cards, wherein the rank is one of E1, E2, E3, E4, E5, E6, E7, E8, E9, WO, O1, O2, O3, O4, O5, O6, O7, O8, O9, O10, and O11/5-star general, in order of value lowest to highest;

the player having the highest value playing card taking the exposed playing cards from the remaining players.

16. The method of claim 15, the method further comprising the step of: if the step of determining indicates that two or more of the exposed cards have an equal rank, then declaring a war.

17. The method of claim 16, the war comprising the steps of:

each of the players corresponding to the exposed cards that have an equal rank placing three playing cards from that players stack then exposing a fourth playing card;

determining which of the fourth playing cards has the highest value by comparing the indicia indicating the rank within the military service on the back surface of the exposed playing cards, wherein the rank is one of E1, E2, E3, E4, E5, E6, E7, E8, E9, WO, O1, O2, O3, O4, O5, O6, O7, O8, O9, O10, and O11/5-star general, in order of value lowest to highest; and declaring the player having the fourth playing card having the highest value a winner of the war.

18. The method of claim 15, wherein the rank corresponds to a pay grade within the military service.

19. The method of claim 15, wherein the indicia further comprises an emblem that corresponds to the branch of the military service and to the rank.

20. The method of claim 15, wherein the back surface includes a letter indicia and a numeral indicia indicating the pay grade.

* * * * *